United States Patent [19]

Chicha

[11] 4,324,081

[45] Apr. 13, 1982

[54] WALL CONSTRUCTION

[76] Inventor: George Chicha, S. 2225 Inland Empire Way, Spokane, Wash. 99204

[21] Appl. No.: 89,018

[22] Filed: Oct. 29, 1979

[51] Int. Cl.[3] ..... E04B 1/41; E04B 1/54; E04B 1/60

[52] U.S. Cl. ..... 52/432; 52/245; 52/396; 52/583; 52/747

[58] Field of Search ..... 52/245, 583, 601, 747, 52/396, 432; 405/275

[56] References Cited

U.S. PATENT DOCUMENTS

| | | | |
|---|---|---|---|
| 637,935 | 11/1899 | Jeckel | 52/583 X |
| 969,343 | 9/1910 | Conkling | 405/275 |
| 1,319,731 | 10/1919 | Striverud | 52/432 X |
| 1,425,117 | 8/1922 | Lynde | 52/432 |
| 1,558,801 | 10/1925 | Frey | 52/245 X |
| 1,834,842 | 12/1931 | Houghtaling | 52/583 X |
| 2,309,149 | 1/1943 | Wood et al. | 52/396 X |
| 2,746,283 | 5/1956 | Abrams | 52/432 X |
| 3,478,481 | 11/1969 | Heierli et al. | 52/432 |
| 3,555,763 | 1/1971 | Bloxom | 52/601 X |
| 3,824,751 | 7/1974 | Shelander | 52/245 X |
| 4,075,855 | 2/1978 | Meldner | 52/396 |

FOREIGN PATENT DOCUMENTS

| | | | |
|---|---|---|---|
| 874370 | 4/1953 | Fed. Rep. of Germany | 52/583 |
| 203940 | 2/1966 | Sweden | 52/432 |

*Primary Examiner*—Alfred C. Perham
*Attorney, Agent, or Firm*—Robert Keith Sharp

[57] ABSTRACT

A wall is formed of large, preformed structural slabs containing horizontally extending reinforcing members. The reinforcing members are made interlocking so that adjacent slabs in the same course are locked together horizontally. The slabs are placed in the wall vertically aligned, so that the reinforcing members and locking means (which extend outside the preformed concrete slabs) of slabs of successive courses can be welded together, giving a skeleton of steel which imparts great strength and earthquake resistance to the structure. Preferably, the structure is a silo and the slabs are arcuate.

10 Claims, 9 Drawing Figures

WALL CONSTRUCTION

This invention relates to wall construction, and preferably to silo construction, the term "silo" being used in a very broad sense of a vertical cylindrical structure for containing solids, semi-solid or liquid material such as ensilage, sand, gravel, cement, grain, coal, water, sewage, and the like, or for protecting equipment either above or below ground. It is also intended to include cylindrical or partially cylindrical structures positioned with their axes horizontal or inclined, such as culverts, viaducts or tunnel linings. In the remainder of the specification, including the claims, I will, for convenience, use language based on a vertical structure. It should be understood, however, that the terms used are to apply to structures in other positions. For example, "vertically" should be taken to mean parallel to the axis of the cylinder, and "horizontally" to mean peripherally of the cylinder in a plane normal to the axis.

Moreover, the invention is applicable to the construction of straight walls, of buildings or other structures. Since, however, silos constitute the best mode in which I have contemplated applying the invention, the remainder of the description will be directed to that type of structure.

BACKGROUND

Silos have been made in many different ways, for example, of wood staves, sheet metal, concrete block, poured concrete. Each mode of construction has its characteristic advantages and disadvantages.

SUMMARY OF THE INVENTION

This invention involves the construction of a silo of large, pre-formed, arcuate concrete structural slabs. These slabs are reinforced and the reinforcing members are made interlocking so that adjacent slabs of the same course are locked together horizontally. These slabs are arranged vertically aligned rather than staggered as has been the usual arrangement of concrete blocks in the past, so that the reinforcing members and locking means of slabs of successive courses can be welded together, giving a skeleton of steel which imparts great strength and earthquake resistance to the structure.

In more detail, each slab, which is several feet high, several inches thick and has a length several times that of its height, includes a plurality of vertically spaced longitudinally extending reinforcing bars. At each end of the slab is a vertically extending steel connecting member to which the reinforcing bars are welded. These connecting members have interlocking portions. They are so formed that by positioning the slabs by a vertical movement the adjacent slabs of a given course are interlocked. These interlocking portions are positioned completely outside the concrete slab. The slabs of successive courses are arranged vertically aligned so that the connecting member of one slab is in direct contact with the connecting member of the next adjacent course. After the corresponding slabs of two successive courses are lowered into place, the adjoining ends of the connecting members are welded together. Since, as has been stated above, the interlocking portions of the connecting members are entirely outside the concrete structure of the slabs there is a space between adjacent slabs which makes it possible to perform the welding operation. A non-shrink grout is poured into the space between the slabs and also into the interlocking portions. The dimensions of the latter are so chosen as to leave space for the reception of the grout. When pouring the grout into a given course, sufficient space is left at the top to permit the welding to the next course above.

As a result of this construction, when the silo is finished the connecting members are joined together to form vertical welded steel columns. Since they are joined to each other by reinforcing members within the slabs, the silo possesses a complete welded steel skeleton. This provides a very strong structure and is particularly desirable in its resistance to earthquakes.

The structural slabs are quite large. A typical size is 4 feet high, 13 feet long and 5 inches thick. They are cast at a central plant, transported to the point where the silo is to be erected and erected into place by a crane. This provides a highly mechanized, economical, mode of construction.

DETAILED DESCRIPTION

Brief description of the drawings:

In the drawing,

Referring to FIGS. 1, 8 and 9 of the drawing, the silo indicated generally at 1 is made up of a number of relatively large building units in the form of arcuate slabs 3. These slabs are made of concrete and as shown in FIGS. 2, 3, 4, 5 and 7, contain steel reinforcing bars 5. These reinforcing bars are welded at their ends to connecting members 7 and 9 respectively. Member 7 is provided with an interlocking portion 11 and member 9 with an interlocking portion 13 of complementary form. These locking portions may be of many different types. However, I show in my perferred form portion 11 as a dovetail channel and member 9 as a tenon adapted to fit within the channel 11. It will be noted that the connecting members extend from top to bottom of the slab 3. It may be noted at this time that the top and bottom of the slab are provided with a tongue 15 and a groove 17, respectively. The connecting members 7 and 9 extend only to the top of the slab proper and not to the top of tongue 15. While the reinforcing bars 5 might be welded to the sides of connecting members 7 and 9, I prefer to make the latter of a "comb" form as shown in FIG. 2 and weld the rods 5 to the edges of the "teeth" of the structure. This provides a direct line connection for the transmittal of forces.

It will be noted that the connecting portions 11 and 13 are positioned entirely outside the concrete portion of the block, and that they are straight and uniform in cross section throughout their length. In fact, the connecting members 7 and 9 should extend several inches beyond the concrete. The reason for this will be apparent from the description of the manner of construction of the silo which follows.

Figure 9:
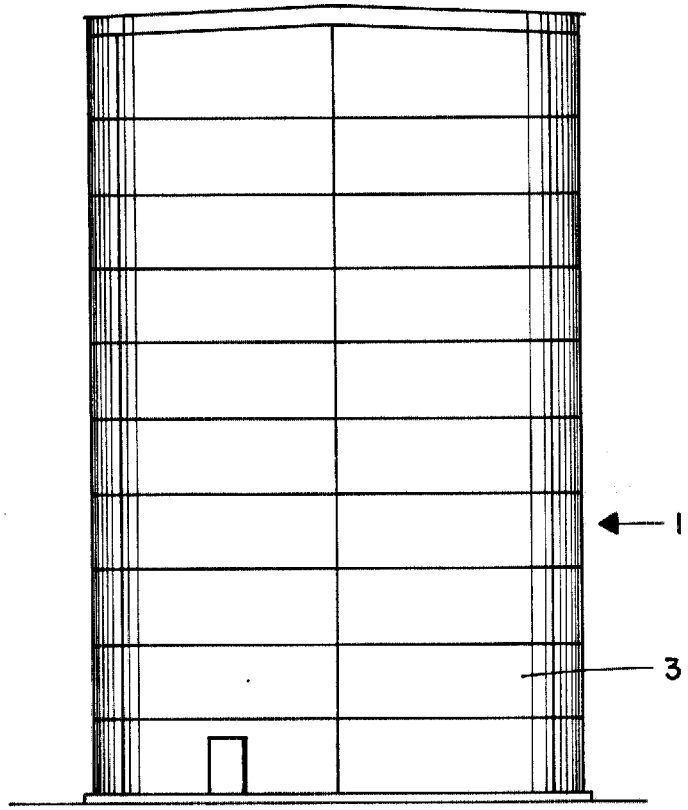
FIG. 9 is an elevation of a finished silo.
Figure 6:
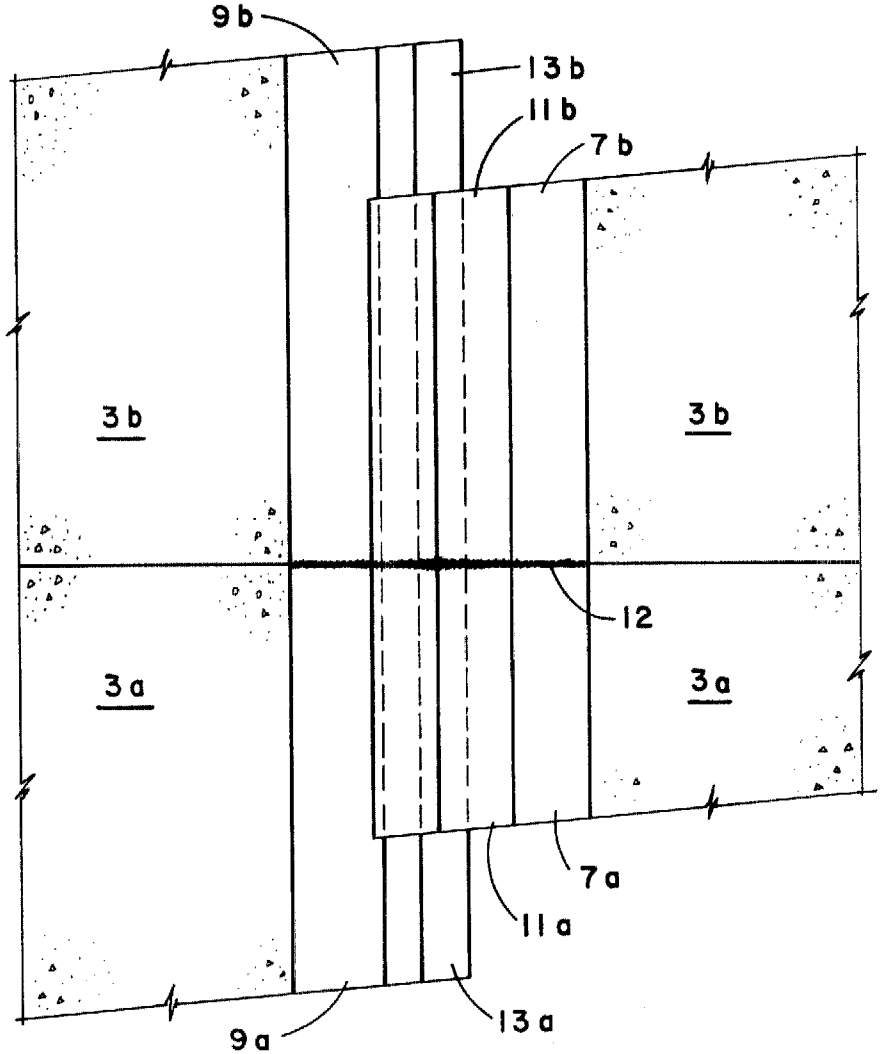
FIG. 6 is an elevation of the joint of FIG. 5, before adding grout, and showing two courses of units.
Figure 8:
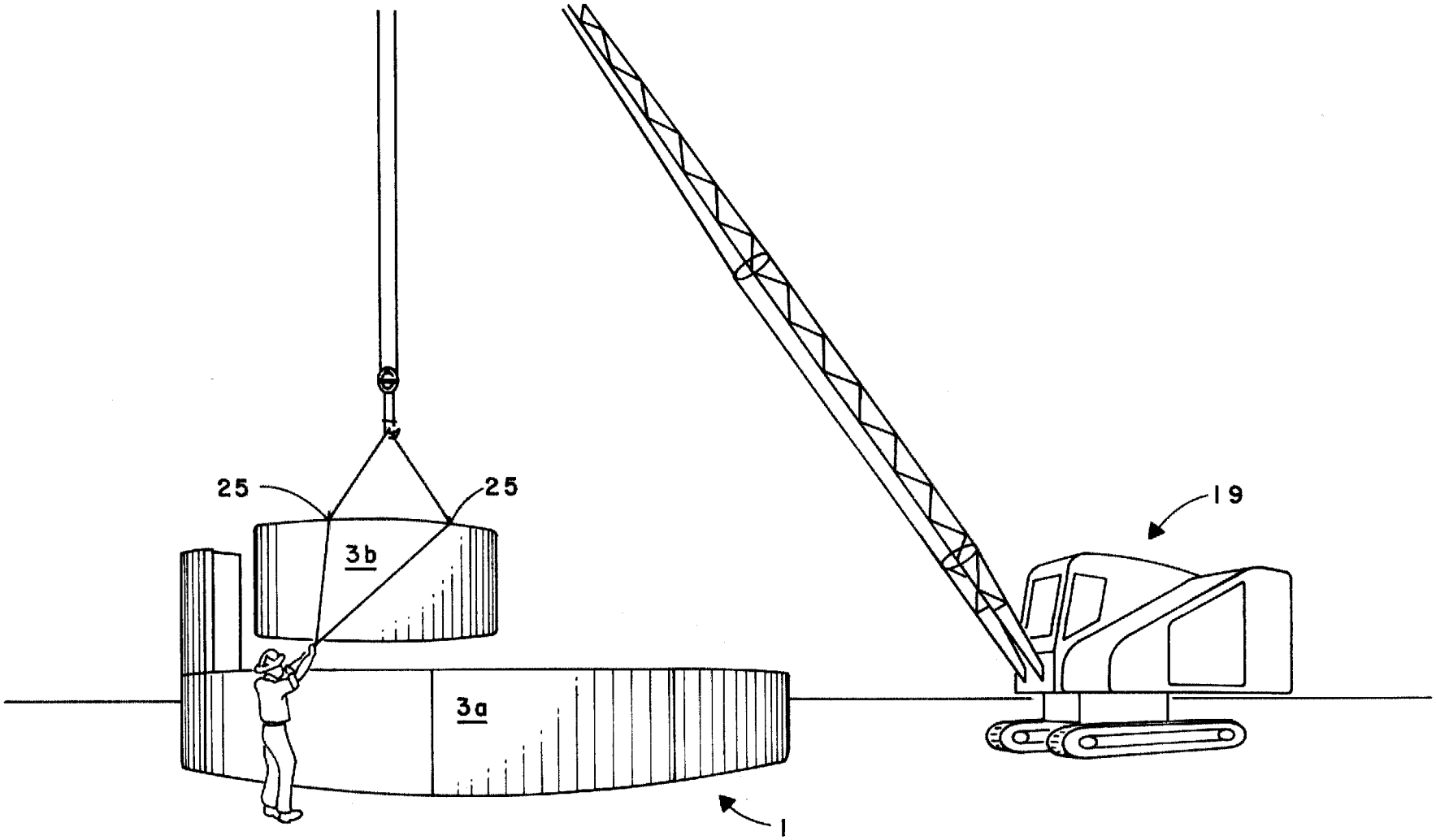
FIG. 8 is a pictorial view showing the assembly of the units to form the silo.

The arcuate slabs 3 are quite large, a typical size being 13 feet long, 4 feet high and 5 inches thick, though these dimensions will of course vary with the size of the silo. The slabs are lifted by a crane 19 as shown in FIG. 8. The successive slabs of a given course are lowered into place vertically so that interlocking portion or tenon 13 of one slab slides within the corresponding channel 11 of an adjacent slab. The space between adjacent slabs 3 and any space within channel 11 not occupied by tenon 13 is filled with a non-shrink grout 21. The grout filling terminates somewhat short of the top of the slab so that the upper portions of connecting members 7 and 9 are exposed. The next course is then laid in the same manner. An important feature of my invention lies in the fact that slabs of successive courses are aligned as shown in FIGS. 6 and 9 and not staggered as has been the usual pattern of concrete block construction. As a result of this alignment the connecting members 7*a* and 9*a* of one slab, designated 3*a* in FIG. 6, are in direct contact with the connecting members 7*b* and 9*b* of the next higher slab 3*b*. The connecting members 7 and 9 of the superposed slabs, including the interlocking portions 11, are then welded together at 12. Non-shrink grout is again poured in, filling the remainder of the space between slabs 3*a* and filling the space between slabs 3*b*, but again stopping short of the top. This procedure is continued until the silo is completed.

As a result of this construction the connecting members 7 and 9 of each joint form a welded steel column extending from top to bottom of the silo and with the reinforcing rods 5 form a complete structural steel skeleton. This provides a very strong structure which is particularly desirable in its resistance to earthquakes.

Figure 1:
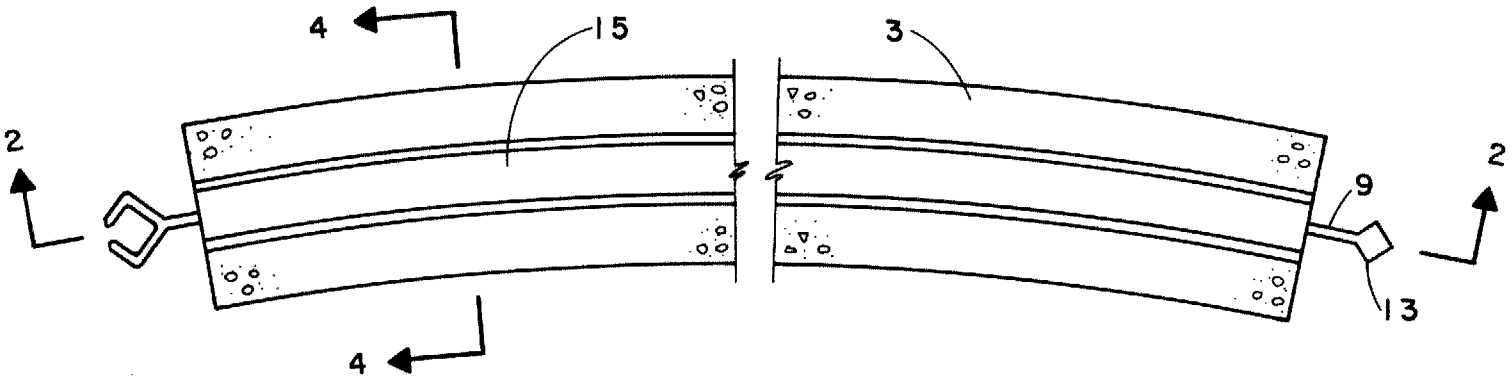
FIG. 1 is a plan view of one of the structural units which I employ in building the silo.
Figure 3:
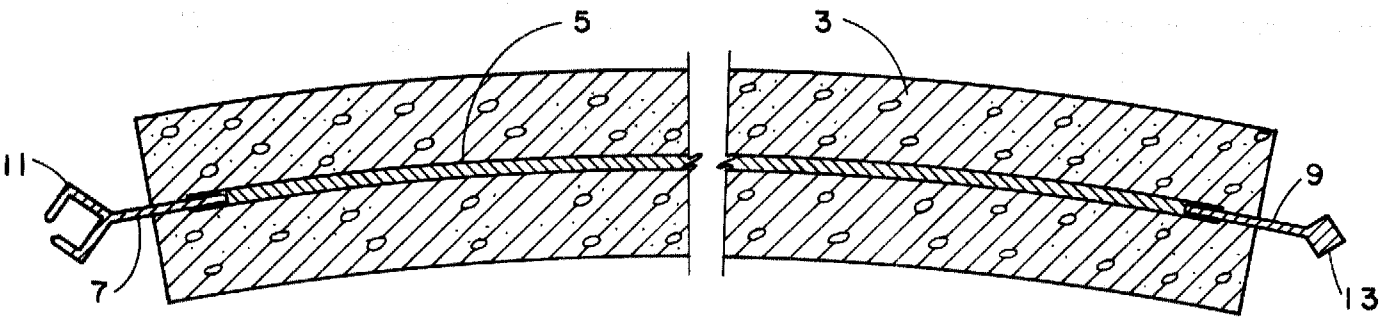
FIG. 3 is a section taken on line 3—3 of FIG. 2.
Figure 2:
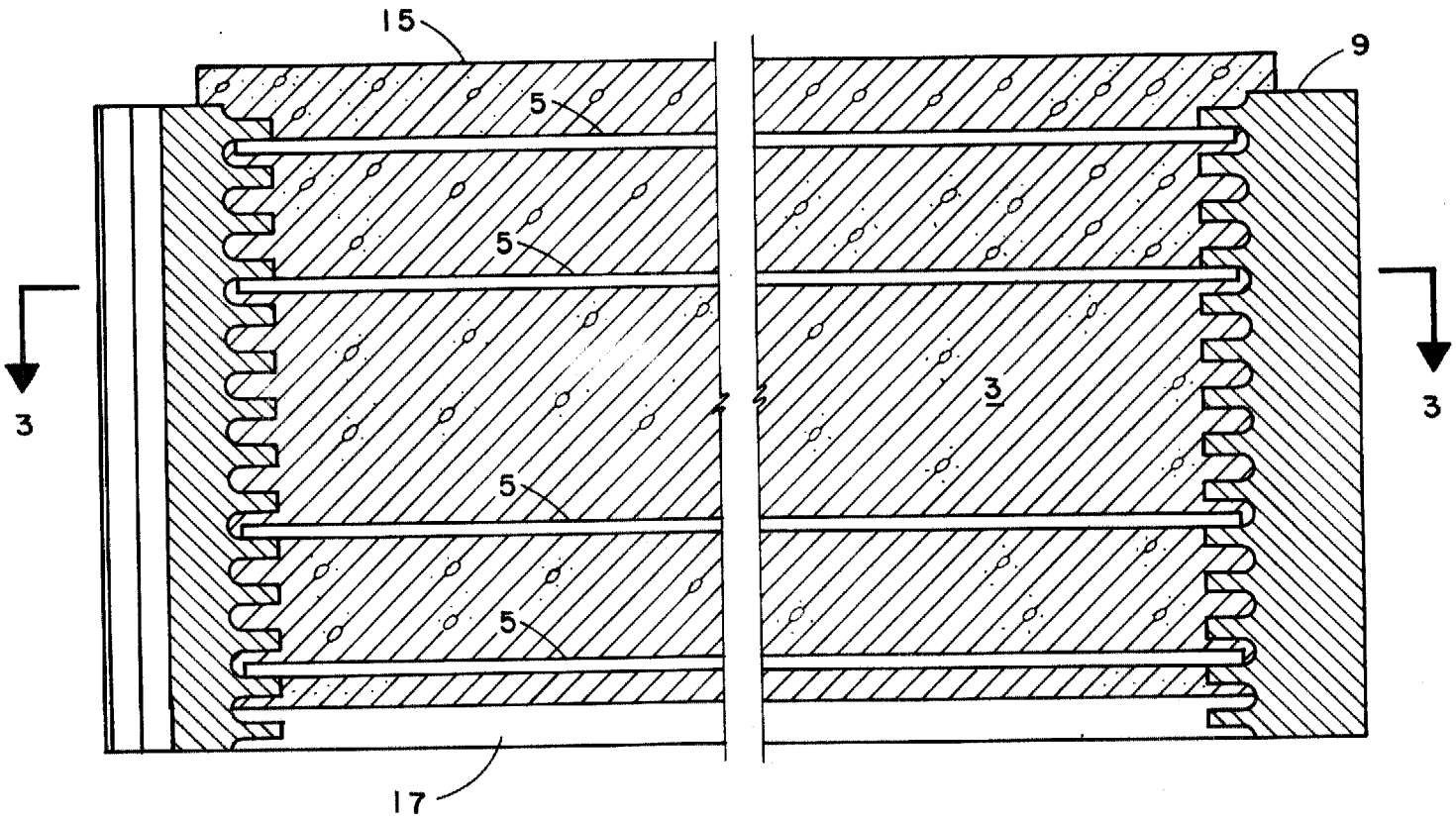
FIG. 2 is a section taken on line 2—2 of FIG. 1.
Figure 5:
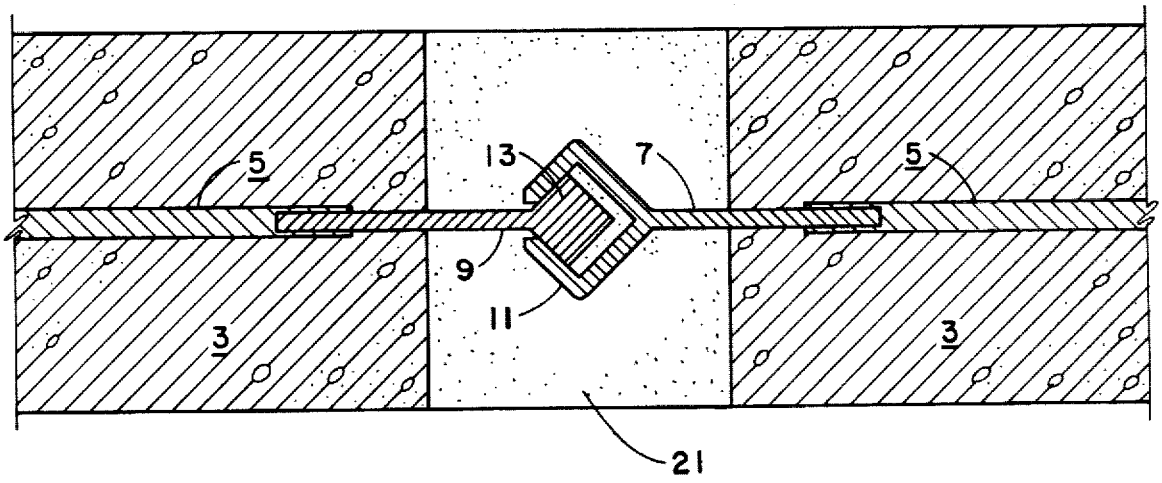
FIG. 5 is a section corresponding to FIG. 3 but showing the joint between the ends of two adjacent units of the same course in a finished silo.
Figure 4:
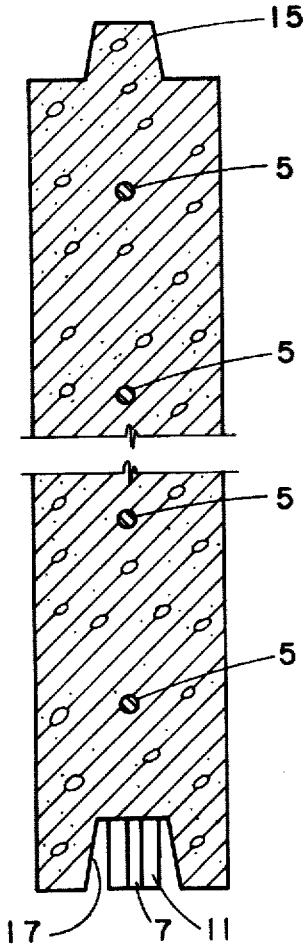
FIG. 4 is a section taken on line 4—4 of FIG. 1.
Figure 7:
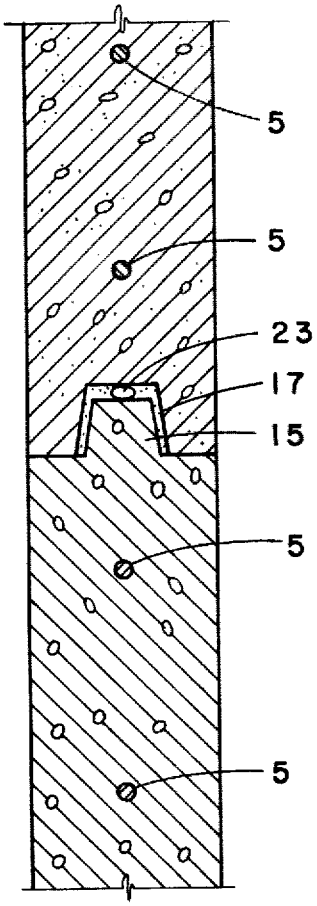
FIG. 7 is a section similar to FIG. 4 but showing two superposed units of different courses.

Referring to FIG. 7, the tongues 15 mate with the grooves 17 of the next higher course. I prefer to provide a gasket 23 of rubber-like material within the joint of this tongue and groove connection to provide a waterproof structure. Alternatively, the space between tongue 15 and the walls of groove 17 may be filled with mortar. Also, the interior of the silo is desirably given a coat of water-proof plastic material.

The slabs as described above are cast at a central plant and transported to the site of erection of the silo. There they are lifted by crane 19 as shown in FIG. 8 and put into place as described above. Various means may be utilized for engaging the slabs for lifting. Preferably the hoist mechanism is provided with clamps 25 (not shown in detail) but eye bolts temporarily set in the concrete may also be used if desired.

This mode of building a silo not only provides a structure which is strong, earthquake resistant and waterproof, but the cost of its construction is low in comparison with other methods of building concrete silos. The concrete structure is desirable since its low conductivity for heat as compared to steel causes less sweating to occur within the structure.

While I have described in considerable detail a specific structure, it will be understood that various changes may be made. I therefore wish my invention to be limited solely by the scope of the appended claims.

The embodiments of the invention in which a proprietary right or privilege is claimed are defined as follows:

1. A wall comprising a plurality of concrete slabs, joined together in successive courses, each of said slabs comprising a plurality of vertically spaced horizontally extending reinforcing members and a vertically extending connecting member at each end of each of said slabs, said connecting members being welded to said reinforcing members and extending the entire distance from top to bottom of each of said slabs, said connecting members having interlocking portions positioned completely outside the concrete of said slabs, extending the full length of said connecting members and being straight and uniform in cross section throughout their length, the connecting members of adjacent slabs in the same course being interlocked, the connecting members of slabs in successive courses being aligned and in direct contact with each other and welded together, whereby said connecting members and said reinforcing members form a complete skeleton for said wall, the spaces between said slabs and said interlocking members being filled with non-shrink grout.

2. A wall as defined in claim 1 wherein one of said connecting members on each slab comprises a dovetail channel and the other connecting member comprises a tenon having a cross section which is complementary to the interior of said channel.

3. A wall as defined in claim 1 wherein the tops and bottoms of said slabs comprise longitudinal tongues and grooves so shaped and positioned that the tongues of one course fit in the grooves of an adjacent course.

4. A wall as defined in claim 3 and further comprising resilient gaskets between said tongues and grooves.

5. A structural unit for a wall comprising a concrete slab having a height many times its thickness and a length several times its height, longitudinal reinforcing members vertically spaced from one another within said slab, connecting members at each end of said slab extending vertically the entire height of said slab and welded to each of said reinforcing members, the connecting members of each slab having complementary interlocking portions so that successive slabs of a given course can be locked together, said interlocking portions being positioned entirely outside the concrete of said slab so that when successive slabs are locked together there is a space between the ends of the concrete, said interlocking portions extending the full length of said connecting members and being straight and uniform in cross section throughout their length.

6. A structural unit as defined in claim 5 wherein one of said connecting members comprises a dovetail channel positioned entirely outside the concrete at one end of said slab and the other connecting member comprises a tenon positioned entirely outside the other end of said concrete portion, said tenon having a cross section which is complementary to the interior of said channel.

7. A structural unit as defined in claim 6, wherein said slab comprises upper and lower parallel surfaces, one of said surfaces having a tongue extending substantially the entire length of said slab and the other of said surfaces having a groove extending substantially the entire length of said slab, said tongue and said groove having complementary cross sections.

8. A structural unit as defined in claim 5, wherein said slab is several inches thick, several feet high and several times as long as high.

9. A method of erecting a wall comprising forming concrete slabs, each of said slabs being several feet in height, several inches in thickness and several times as long as high, and comprising longitudinal reinforcing members vertically spaced from one another within said slab, connecting members at each end of said slab extending vertically the entire height of said slab and welded to each of said reinforcing members, the connecting members of each slab having complementary interlocking portions so that successive slabs of a given course can be locked together, said interlocking portions being positioned entirely outside the concrete of said slab so that when successive slabs are locked together there is a space between the ends of the concrete, said interlocking portions extending the full length of said connecting members and being straight and uniform in cross section throughout their length, transporting said slabs to the point of erection of the wall, lifting said slabs by power and setting them in courses, sliding the interlocking portions of said connecting members into interlocking relationship, the connecting members of all of the courses being aligned, welding said connecting members together and filling the spaces between the slabs and within said connecting members with non-shrink grout.

10. A method as defined in claim 9 comprising partially filling the spaces of each course after it has been laid, but leaving unfilled spaces at the top to permit welding of the connecting members to the connecting members of the next higher course.

* * * * *